US005469995A

United States Patent [19]

Bredeweg et al.

[11] Patent Number: 5,469,995

[45] Date of Patent: Nov. 28, 1995

[54] GARMENT HANGER SIZING SYSTEM

[75] Inventors: Robert Bredeweg; Russell O. Blanchard; Donald F. Morgan, all of Zeeland; Edward J. Dooley, Holland, all of Mich.

[73] Assignee: Batts, Inc., Zeeland, Mich.

[21] Appl. No.: 235,209

[22] Filed: Apr. 29, 1994

Related U.S. Application Data

[63] Continuation-in-part of Ser. No. 57,139, May 5, 1993, abandoned.

[51] Int. Cl.[6] ..... A47G 25/14

[52] U.S. Cl. ..... 223/85; 40/322; 223/92

[58] Field of Search ..... 223/85, 88, 92, 223/95; 211/322; D6/315

[56] References Cited

U.S. PATENT DOCUMENTS

| | | | |
|---|---|---|---|
| 2,857,696 | 10/1958 | Barrow | 40/322 |
| 4,997,114 | 3/1991 | Petrov | 223/85 |
| 5,096,101 | 3/1992 | Norman et al. | 223/85 |
| 5,199,608 | 4/1993 | Zuckerman | 223/85 |
| 5,383,583 | 1/1995 | Zuckerman | 223/85 |
| 5,407,109 | 4/1995 | Zuckerman | 223/85 |

*Primary Examiner*—C. D. Crowder
*Assistant Examiner*—Bibhu Mohanty
*Attorney, Agent, or Firm*—Baker & McKenzie

[57] ABSTRACT

A combination garment hanger and garment size indicating system is provided in the form of a garment hanger equipped with a tab-holding section that accommodates a size-indicating tab. Once the size-indicating tab is inserted into the tab-holding section, it is substantially unremovable. Any removal of the tab from the tab-holding section substantially damages the tab and renders it useless. The tab is ergonomically designed to reduce the likelihood of carpal tunnel syndrome in assembly-line workers charged with the task of installing the tabs on garment hangers.

10 Claims, 2 Drawing Sheets

GARMENT HANGER SIZING SYSTEM

This application is a continuation-in-part of Application Ser. No. 08/157,139, filed on May 5, 1993.

FIELD OF THE INVENTION

This invention relates generally to an improved system for indicating the size of a garment suspended from a garment hanger. Specifically, this invention relates to an improved system for easily indicating the sizes of garments on hangers in retail outlets. Structurally, a garment hanger is equipped with a size-indicating tab that cannot be easily removed from the hanger after it is attached thereto. The tab and tab-holder mounted on the hanger are of an improved ergonomic design that reduces the likelihood of carpal tunnel syndrome in assembly-line workers who attach the tabs to the hangers.

BACKGROUND OF THE INVENTION

The concept of a garment hanger that includes a label indicating the size of the garment hung thereon is well-known. However, modern safety standards require a size-indicating tab to be irremovable once installed on a hanger. From the standpoint of safety, if a small tab can be easily removed from a hanger, it may become lodged in a child's throat. But another problem has arisen in wake of the development of permanently attached size-indicating tabs. Specifically, the tabs are difficult to attach to the hangers and assembly-line workers may develop carpal tunnel syndrome as a result of installing the tabs on the hangers.

By way of background, retail stores have used hangers indicating the size of the garment for a long time. Examples of patented size-indicating garment hangers and/or size-indicating labels for garment hangers include the following U.S. Pat. Nos.: 1,321,926; 1,389,266; 3,535,808; DES.244,197; 3,949,914; 4,997,114 and 4,115,940. Each of the above references include some sort of tag or label attached to the hanger that is visible to the consumer as he/she browses through racks of clothes in a retail store. Because many garments are sold with the hanger, the hangers often find their way into the homes of consumers. Because the tabs disclosed in the above references may be removed from the hangers, sometimes with surprising ease, the tabs have caused injury to young children who have a tendency to put small items in their mouths. The tabs can become lodged in the throat of a child inflicting serious injury or suffocation.

Therefore, the garment hanger industry began to develop size-indicating tabs that could not be easily removed from garment hangers. One such example is found in U.S. Pat. No. No. 5,096,101. This patent discloses a plastic tab that is forced over a tab holder that includes two triangular cross-sections. The U-shaped tab includes two inwardly protruding ends and two projections. Both the ends and the projections are captured underneath the enlarged regions of the triangular cross-sections. The result is a double-locking tab that cannot be removed from the hanger without substantially damaging or destroying the tab.

However, it will be noted that the tab disclosed by the 5,096,101 patent is rather difficult to attach to the tab holder. Specifically, the assembly-line worker must firmly grasp the tab and impart undue amounts of twisting and pushing forces on the tab to push it over both triangular cross-sections and into the locking position. Because the assembly-line worker must firmly grasp the tab and thereafter firmly press the tab inward or downward on the hanger to lock the tab into place, the probabilities for the occurrence of carpal tunnel syndrome are increased.

Carpal tunnel syndrome is a common nerve disorder affecting the hands, wrist and forearm of its victims. Specifically, carpal tunnel syndrome results from the compression of the median nerve at the wrist, within the carpal tunnel. The carpal tunnel acts as a conduit for important nerves, blood vessels and tendons extending through the wrist to the thumb and fingers. The compression of nerves in the carpal tunnel causes sensory and motor changes in the median distribution of the hand. Carpal tunnel syndrome usually occurs in women between ages 30 and 60 and poses a serious occupational health problem. Assembly-line workers, packers and persons who repeatedly use poorly designed tools are most likely to develop this disorder. Any strenuous use of the hands, including sustained grasping, twisting or turning, may aggravate this condition.

Difficult-to-install tabs like the ones shown in U.S. Pat. No. 5,096,101 may contribute to the development of carpal tunnel syndrome in assembly-line workers. Therefore there is a need for an improved size-indicating tab that is easier for the assembly-line worker to install on the garment hanger. The size-indicating tab must also include the non-removable aspects previously known so as to not create a child-safety problem.

SUMMARY OF THE INVENTION

The present invention makes a significant contribution to the garment hanger art by providing an improved size-indicating system. The hanger resulting from the present invention is safe for use in homes with small children and further is easy to manufacture and avoids requiring the assembly-line worker to perform an excessive amount of grasping, twisting or turning which may lead to the development of carpal tunnel syndrome.

The improved garment hanger includes a hang means connected to a middle portion of a garment support member. The tab-holding section is preferably mounted to one side of the hook or hang means where the hang means is connected to the garment support member. The tab-holding section includes a wall that is preferably connected to both the hang means and the garment support member. The wall extends outwardly toward the consumer as the garment and hanger are hung from a rack. The wall terminates at a bullet-shaped member which serves as a male connector for the tab. The bullet-shaped member is connected to the end of the wall at the base of the bullet-shaped member.

The improved size-indicating tab of the present invention is preferably U-shaped. A front end of the tab is disposed between two side members. The opposing side members extend away from the consumer and terminate in two inwardly curved ends. The front end of the tab serves as a rigid hinge connection between the two opposing side members and the outer front wall of the front end serves as a space for indicating the size of the garment.

When the tab is installed on the tab-holding section of the hanger, the front display wall, indicating the size of the garment, faces outward or frontward, toward the consumer. In a relaxed position the two inwardly curved ends of the tab are separated by a distance. This defined distance is approximately equal to the thickness of the wall that connects the bullet-shaped member to the hanger. When the tab is inserted over the bullet-shaped member, the inwardly curved ends extend past the base of the bullet-shaped member and snap inward toward their relaxed position and either positively engage or at least abuttingly engage the wall which connects the bullet-shaped member to the hanger.

In the preferred embodiment, the inwardly curved ends of the opposing side members of the tab are further characterized as terminating in substantially flat inner walls that engage the wall that connects the bullet-shaped member to the hanger. Each flat inner wall of a curved end is disposed between a rounded edge and a relatively square edge. The rounded edge is the distal or outermost portion of the tab and provides a smooth engagement between the tab and the narrow front end of the bullet-shaped member when the tab is pushed over the bullet-shaped member during installation of the tab. The square edge of each inwardly curved end is disposed adjacent to the base portion of the bullet-shaped member after the tab is installed. The engagement of the square edges of the curved ends of the tabs with the base portion of the bullet-shaped member precludes removal of the tab from the hanger without substantially damaging or destroying the tab.

Thus, a practically unremovable size-indicating tab is provided that is also easy to install. The rounded outermost edges of the tabs slide easily over the smooth bullet-shaped connecting member and do not require an excessive amount of strain, grasping or twisting action on the part of the assembly-line worker. Further, the relatively square edge disposed opposite the inwardly facing wall of the curved end is accommodated or captured underneath the base portion of the bullet-shaped member. To remove the tab from the tab-holding section, both square edges of the tab must be pulled outward and around the steps presented by the connection of the base portion of the bullet-shaped member to the wall which connects the bullet-shaped member to the hanger. Thus, both curved ends must be substantially spread apart and pulled off simultaneously. This complicated action is not within the mechanical skills of small children and therefore the size-indicating tab of the present invention does not present a child-safety threat.

It is therefore an object of the present invention to provide an improved size-indicating tab for garment hangers.

Another object of the present invention is to provide an improved size-indicating tab for garment hangers that is easier for assembly-line workers to install thereby reducing the risk of carpal tunnel syndrome in the workers.

Yet another object of the present invention is to provide an easy-to-install size-indicating tab that may also be used in homes with small children without creating any substantial risk to the safety of the children.

BRIEF DESCRIPTION OF THE DRAWINGS

This invention is illustrated more or less diagrammatically in the accompanying drawing, wherein.

DETAILED DESCRIPTION OF THE INVENTION

Figure 1:
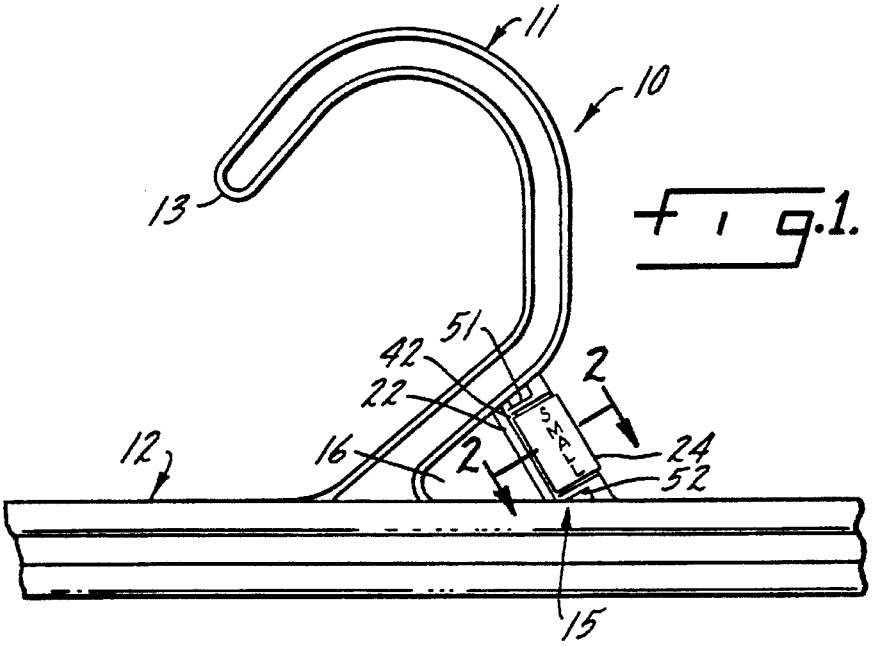
FIG. 1 is a partial front elevational view of a garment hanger, tab-holder and tab made in accordance with the present invention.

Like reference numerals will be used to refer to like or similar parts from Figure to Figure in the following description of the drawing.

As seen in FIG. 1, the garment hanger 10 includes a hang means 11 which is connected to the garment support member 12. In the retail environment, the distal end 13 of the hang means 11 is hung over a rack and is directed away from the consumer. Therefore, the size-indicating tab 24 is directed outward, toward the consumer. The tab-holding section, indicated generally at 15, (see FIGS. 2 and 3) is preferably connected to both the hang means 11 and the garment support member 12.

Figure 2:
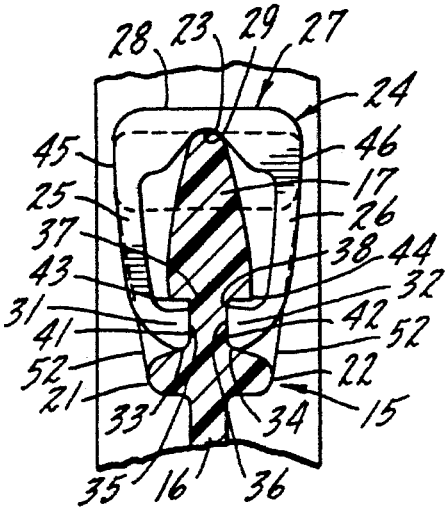
FIG. 2 is a section view taken substantially along line 2—2 of FIG. 1.
Figure 3:
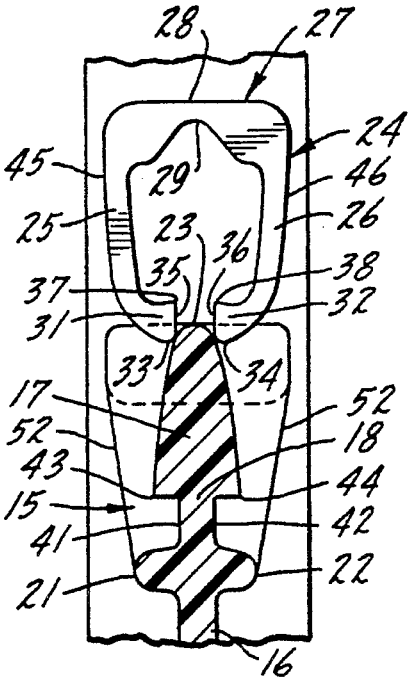
FIG. 3 is the same section view shown in FIG. 2 illustrating the tab as it is being initially inserted over the tab holder.

Referring to FIGS. 1 through 3 collectively, the tab-holding section 15 includes a wall or base member 16 which is connected to the garment support member 12 and the hang means 11. The wall or base member 16 is connected to the bullet-shaped member, also known as a seat member, 17 at the base portion 18 thereof. In the preferred embodiment, outwardly extending ribs 21, 22 may be disposed on the wall 16 to provide structural support and block access to the tab 24 after installation. Upper and lower ribs 51, 52 respectively also block access to the tab 24 after installation. The bullet-shaped member terminates at a narrow front end 23.

The size-indicating tab 24 engages the tab-holding section 15 as seen in FIG. 3. The tab 24 includes two opposing side members 25, 26. Both opposing side members 25, 26 are attached to the front end 27 of the tab 24. The front end 27 includes a front display wall 28 and a slot or bright 29 for accommodating the front end 23 of the bullet-shaped member or seat member 17.

The opposing side members 25, 26 terminate in two inwardly curved ends 31, 32. The inwardly curved ends 31, 32 feature rounded edges 33, 34, inwardly facing walls 35, 36 and square edges 37, 38.

As the tab 24 is inserted over the bullet-shaped member 17, the rounded edges 33, 34 initially engage the front end or nose 23 of the bullet-shaped member. The rounded configuration of the edges 33, 34 along with the general rounded configuration the front end 23 of the bullet-shaped member 17 make it easy to slide the curved ends 31, 32 of the tab 24 over the bullet-shaped member 17. It will be noted from FIGS. 1 and 2 that the distance between the inwardly facing walls 35, 36 of the tab 24 is generally about the same thickness as the wall 16 and the distance between the inwardly facing walls 35, 36 is substantially less than the average thickness of the bullet-shaped member and substantially less than the thickness represented by the base portion 18 of the bullet-shaped member 17. Thus, the tab 24 must be made of some resilient material, such as plastic or other thermoplastic materials, and must be forced over the bullet-shaped member 17.

The rounded edges 33, 34 and the rounded configuration of the bullet-shaped member 17 enables the tab 24 to be inserted over the bullet-shaped member 17 with a minimum of effort. Once the tab 24 is pushed past the bullet-shaped member 17, the inwardly facing walls 35, 36 are accommodated in the receiving sections 41, 42 that are disposed between the ribs 21, 22 and the base portion 18 of the bullet-shaped member 17. Any attempt to pull the tab 24 out of the tab-holding section 15 will result in the engagement of the square edges 37, 38 against the square edges 43, 44 of the base portion 18 of the bullet-shaped member 17. Thus, to remove the tab 24 from the tab-holding section 15, the opposing side members 25, 26 must be grasped, spread apart so that the flat inner walls 35, 36 of the inwardly curved end portions 31, 32 clear the edges 43, 44 of the base portion 18 of the bullet-shaped member 17. This sort of simultaneous grasping and pulling requires dexterity that is beyond the capabilities of small children.

Figure 4:
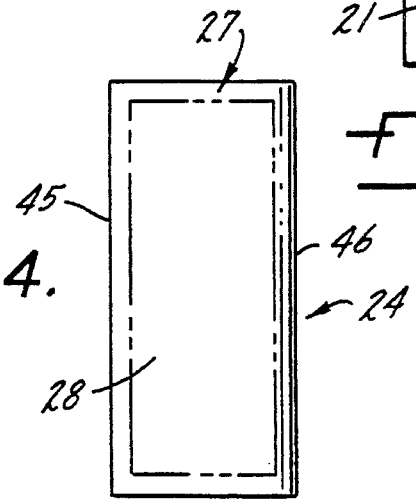
FIG. 4 is the front elevation view of the tab showing the front display wall thereof.

Referring to FIGS. 2, 3 and 4 collectively, the tab 24 includes 3 areas for the display of the garment size. The front display wall 28 extends frontward or outward and faces the consumer as the consumer browses along full racks of clothes in a retail store. Outer side walls 45, 46 also provide a place to display the size of the garment.

Thus, a new sizing system is provided for the garment industry which reduces the aggravation and strain associated with carpal tunnel syndrome as well as providing a hanger that is safe for use in homes with small children. The tab 24 may be installed by pushing inward or in a plane represented by the front end 23 of the bullet-shaped member and the wall 16 or, the tab 24 may be inserted using a rolling action made easier by the rounded edges 33, 34 disposed at the distal ends of the side members 25, 26 of the tab 24. The accommodation of the front end 23 of the bullet-shaped member 17 in the slot or bight 29 in combination with the flat inwardly facing walls 35, 36 of the curved end portions 31, 32 provides rocking-free stability of the tab once installed on the hanger. The stability afforded by the installed tab 24 also precludes removal of the tab 24 from the hanger 10.

Because the opposing side members or side walls 25, 26 would have to be stretched substantially outward in order to remove the tab 24 from the hanger 10, the tab 24 would be substantially damaged and rendered useless if it were successfully removed. Rendering the tab 24 useless after one removal ensures that worn or structurally tired tabs 24 will not be installed on hangers 10 which may find their way into the homes of consumers with small children. The structure of the tab 24 ensures that it will be used only once.

Figure 5:
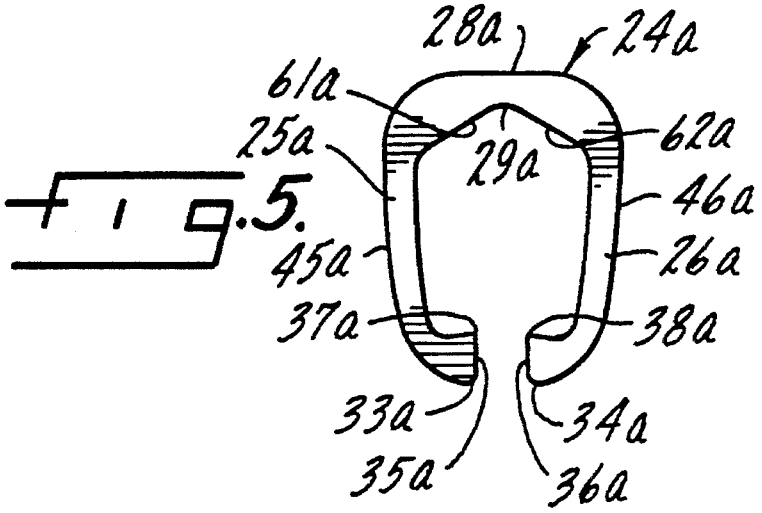
FIG. 5 is an end view an alternative tab made in accordance with the present invention.
Figure 6:
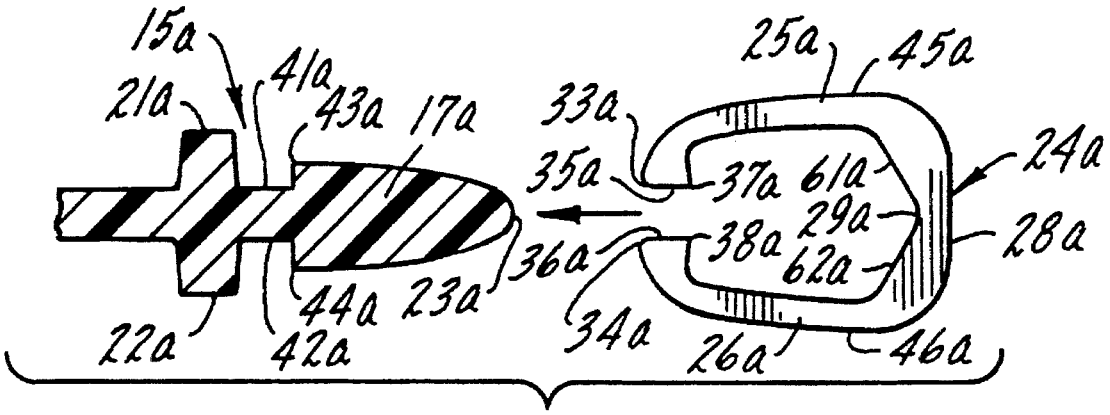
FIG. 6 is a sectional view illustrating the alternative tab prior to insertion over an alternative tab holder, also made in accordance with the present invention.

FIGS. 5 and 6 illustrate additional embodiments of the tab 24*a* and tab-holding section 15*a* respectively. Referring first to FIG. 5, the sections 61*a*, 62*a* disposed between the slot 29*a* and the side members 25, 26 has been flattened. Referring to FIG. 5, instead of the rounded ribs 21, 22 as shown in FIGS. 2 and 3, squared ribs 21*a*, 22*a* are employed. The bullet-shaped member 17*a* is also slightly wider than the bullet-shaped member 17 shown in FIGS. 2 and 3. Like reference numerals with the suffix "a" are used to identify the remaining elements which are discussed above in connection with FIGS. 4 and 5.

Although only two preferred embodiments of the present invention has been illustrated and described, it will at once be apparent to those skilled in the art that variations may be made within the spirit and scope of the present invention. Accordingly, it is intended that the scope of the present invention be limited solely by the scope of the hereafter appended claims and not by any specific wording in the foregoing description.

We claim:

1. A system for indicating the size of a garment hung on a garment hanger, the system comprising;

a garment support member connected to a hang means, a tab-holding section disposed at the connection between the garment support member and the hang means, the tab-holding section including a wall connecting the tab-holding section to the hanger, the wall extending frontward toward the consumer and terminating at a base portion of a bullet-shaped member, the wall defining a thickness, a tab for connection to the tab-holding section, the tab including two opposing side members with a front end disposed between the two opposing side members, the opposing side members having smooth inward facing surfaces which are free of projecting members, the opposing side members extending rearward and terminating at inwardly curved ends, the inwardly curved ends defining a distance therebetween, said distance being substantially equal to the thickness of the wall, the tab engaging the bullet-shaped member so that the curved ends are in substantial abutting engagement with the wall immediately rearward of the base portion of the bullet-shaped member and the bullet-shaped member being disposed between the opposing side members and rearward of the front end of the tab, the curved ends of the opposing side members being resiliently biased inward toward each other thereby precluding removal of the tab from the bullet-shaped member without causing substantial damage to the tab.

2. The system of claim 1, wherein the inwardly curved ends of the opposing side members are further characterized as terminating in substantially flat inner walls, each inner wall being disposed between a substantially square edge and a rounded edge, the rounded edge being disposed rearward and being arranged so that the rounded edge first engages a narrow front end of the bullet-shaped member as the tab is forced rearward over the bullet-shaped member, the square edge being disposed immediately rearward of the base portion of the bullet-shaped member when the tab is fully engaging the bullet-shaped member, engagement of the square edges of the inwardly curved ends with the base portion of the bullet-shaped member precluding removal of the tab from the bullet-shaped member without causing substantial damage to the tab.

3. The system of claim 2, wherein the wall of the tab-holding section includes two opposing outwardly extending ribs, the ribs being disposed between the bullet-shaped member and the hanger, the wall also including receiving sections disposed between each rib and the bullet-shaped member, the receiving sections accommodating the flat inner walls of the inwardly curved ends of the opposing side members of the tab, the flat inner walls of the inwardly curved ends extending substantially across the receiving sections.

4. The system of claim 3, wherein the tab is generally U-shaped, the front end including a slot disposed behind the front display wall, the slot accommodating the narrow front end to the bullet-shaped member, the slot also providing a stiff hinge-like connection between the two opposing side members of the tab.

5. The system of claim 4, wherein the bullet-shaped member is connected to the wall at a central portion of the base portion, the base portion being wider than the thickness of the wall thereby defining two steps on opposing sides of the wall, engagement of the square edges of the curved ends of the side members in the steps defined by the connection of the base portion to the wall precluding removal of the tab from the bullet-shaped member without substantial damage to the tab.

6. An improved garment hanger that indicates the size of a garment hung thereon to the consumer, the hanger comprising;

a hang means connected to a central portion of a garment support member, a tab-holding section being disposed at the connection between the hang means and the garment support member, the tab-holding section including a wall connecting the tab-holding section to the hang means and the garment support member, the wall extending frontward toward the consumer and terminating at a base portion of a bullet-shaped member, the wall defining a thickness, the wall also accommodating two outwardly extending ribs disposed on opposing sides of the wall and rearward of the base portion of the bullet-shaped member, the wall providing two receiving sections, one receiving section disposed between each rib and the base portion of the bullet-shaped member, the bullet-shaped member extending forward toward the consumer and including a narrow front end, the base portion being wider than the narrow front end and being connected to an end of the wall of the tab-holding section, a tab connected to the tab-holding section, the tab including two opposing side members with a front end disposed therebetween, the opposing side members having smooth inward facing surfaces which are free of projecting members, the opposing side members extending rearward and terminating in inwardly curved ends, the distance between said inwardly curved ends being substantially equal to the thickness of the wall, the curved ends of the opposing side members being further characterized as terminating in substantially flat inner walls, each flat inner wall being disposed between a substantially square edge and a rounded edge, the tab engaging the bullet-shaped member so that the square edges of the curved ends of the tab are disposed immediately rearward of the base portion of the bullet-shaped member when the tab is engaging the bullet-shaped member, the flat inner walls of the curved ends are in substantial abutting engagement with and extend substantially across the receiving sections of the wall and the bullet-shaped member is disposed between the opposing side members and rearward of the front end of the tab, the curved ends of the opposing side members being resiliently biased inward toward each other and engagement of the square edges of the curved ends with the base portion of the bullet-shaped member precluding removal of the tab from the bullet-shaped member without substantial damage to the tab, the narrow front end of the bullet-shaped member being accommodated between the curved ends of the opposing side members when the opposing side members are in a relaxed state, the base portion of the bullet-shaped member being accommodated between the curved ends of the opposing side members only when the opposing side members are forced outward under force imposed by the base portion of the bullet-shaped member as the tab is being forced rearward over the bullet-shaped member, the rounded edges of the curved ends being disposed rearward and the rounded edges first engaging the narrow front end of the bullet-shaped member as the tab is forced rearward over the bullet-shaped member.

7. An improved garment hanger that indicates the size of a garment hung thereon to the consumer, the hanger comprising;

a hang means connected to a central portion of a garment support member, a tab-holding section being disposed at the connection between the hang means and the garment support member, the tab-holding section including a wall connecting the tab-holding section to the hang means and the garment support member, the wall extending frontward toward the consumer and terminating at a base portion of a bullet-shaped member, the wall defining a thickness, the wall also accommodating two outwardly extending ribs disposed on opposing sides of the wall and rearward of the base portion of the bullet-shaped member, the wall providing two receiving sections, one receiving section disposed between each rib and the base portion of the bullet-shaped member, a tab connected to the tab-holding section, the tab including two opposing side members with a front end disposed therebetween, the opposing side members having smooth inward facing surfaces which are free of projecting members, the opposing side members extending rearward and terminating in inwardly curved ends, the distance between said inwardly curved ends being substantially equal to the thickness of the wall, the curved ends of the opposing side members being further characterized as terminating in substantially flat inner walls, each flat inner wall being disposed between a substantially square edge and a rounded edge, the tab engaging the bullet-shaped member so that the square edges of the curved ends of the tab are disposed immediately rearward of the base portion of the bullet-shaped member when the tab is engaging the bullet-shaped member, the flat inner walls of the curved ends are in substantial abutting engagement with and extend substantially across the receiving sections of the wall and the bullet-shaped member is disposed between the opposing side members and rearward of the front end of the tab, the curved ends of the opposing side members being resiliently biased inward toward each other and engagement of the square edges of the curved ends with the base portion of the bullet-shaped member precluding removal of the tab from the bullet-shaped member without substantial damage to the tab.

8. In combination with a garment hanger having garment support means and hang means, size indicator means carried by said garment hanger, said size indicator means including a base member extending away from said garment hanger, a seat member disposed at a distal end of the base member, a portion of the seat member which is adjacent the base member having a greater thickness than a thickness defined by a distal end of the seat member, a size indicator tab construed and arranged to assemble to the seat member, said size indicator tab having a generally U-shaped configuration which includes a bight portion and a pair of side walls which extend in generally the same direction from the bight portion of the tab, said bight portion, when the tab is assembled to the seat member, being disposed at the distal end of the seat member, a distal free end of each side wall having an end portion which projects inwardly toward the base member when the tab is assembled to the seat member, an open distance between said inwardly projecting end portions of each of said side walls which projects toward the base member being less than the thickness of the seat member adjacent the base member to thereby resist separation of the tab from the seat member, no portion of the side walls between the bight portion and the end portions of the side walls which extend inward towards the base member being in separation restraining engagement with the seat member.

9. The garment hanger of claim 8 further characterized in that the distal end of seat member is seated in the bight portion of the tab.

10. The garment hanger of claim 8 further characterized by and including blocking means projecting outwardly from the base member on each side thereof at a location toward the hang means from the inwardly projecting end portion of the distal end of each side wall, said blocking means being located so close to the said distal ends of the side walls as to preclude obtaining a finger purchase on the said distal ends of the tab walls.

* * * * *